United States Patent [19]

Wagner

[11] Patent Number: 4,927,194

[45] Date of Patent: May 22, 1990

[54] INTERLOCK LATCH ASSEMBLY FOR RELEASABLY SECURING COWL SECTIONS OF AN OUTBOARD MOTOR

[75] Inventor: James L. Wagner, Neenah, Wis.

[73] Assignee: Notron Engineering AG, Zollbruck, Switzerland

[21] Appl. No.: 219,086

[22] Filed: Jul. 14, 1988

[51] Int. Cl.[5] ..... E05C 19/10

[52] U.S. Cl. ..... 292/128; 292/106; 440/77

[58] Field of Search ..... 292/106, 129, 121, 128, 292/208, 207, 229; 440/77

[56] References Cited

U.S. PATENT DOCUMENTS

| | | | |
|---|---|---|---|
| 1,153,514 | 9/1915 | North et al. | 292/210 |
| 2,379,970 | 7/1945 | Koebel | 292/207 X |
| 2,663,585 | 12/1953 | Tye | 292/106 |
| 3,240,523 | 3/1966 | Heimann | 292/229 X |
| 3,463,530 | 8/1969 | Modes | 292/128 |
| 3,468,142 | 9/1969 | Sprung | 292/106 X |
| 3,773,010 | 11/1973 | Elingsen . | |
| 3,955,526 | 5/1976 | Kusche . | |
| 4,216,984 | 8/1980 | Hofmann et al. . | |
| 4,600,396 | 7/1986 | Crane et al. . | |

FOREIGN PATENT DOCUMENTS

| | | | |
|---|---|---|---|
| 60-60098 | 4/1985 | Japan | 440/76 |

*Primary Examiner*—Gary L. Smith
*Assistant Examiner*—Michael J. Milano
*Attorney, Agent, or Firm*—Welsh & Katz, Ltd.

[57] ABSTRACT

An interlock mechanism is provided for a latch assembly which releasably secures upper and lower cowl sections of an outboard motor. The interlock mechanism is movable between a locking position and a release position, and is normally disposed in its locking position, such as by a coil spring. The interlock mechanism is mounted to the latch handle, which is pivotably mounted to one of the cowl sections. A hook is interconnected with the latch handle, and is engageable with a catch assembly provided on the other of the cowl sections. The interlock assembly normally engages a stationary engagement pin provided on one of the cowl sections, which prevents accidental pivoting movement of the latch handle. The interlock mechanism is manually movable to its release position, so that the latch handle can be pivoted so as to disengage the hook from the catch mechanism.

5 Claims, 3 Drawing Sheets

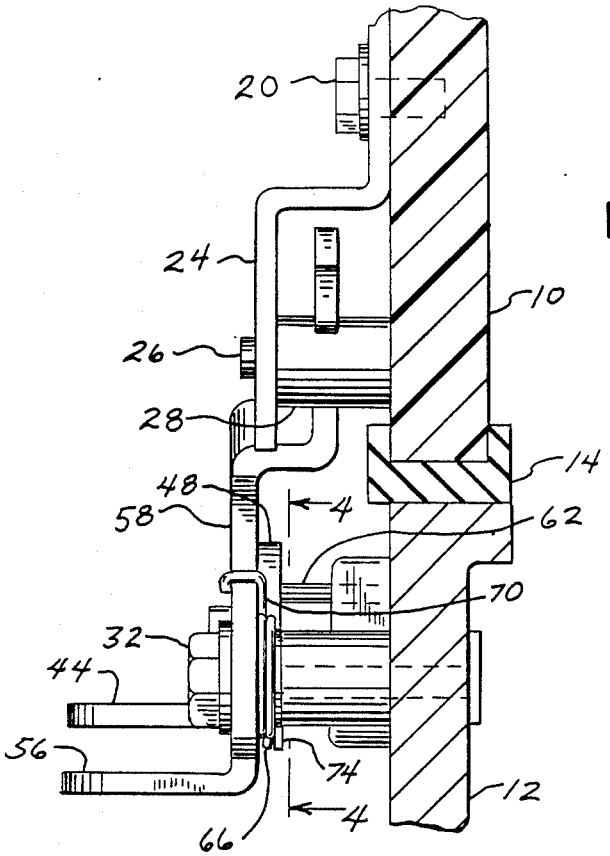
FIG. 3
FIG. 4
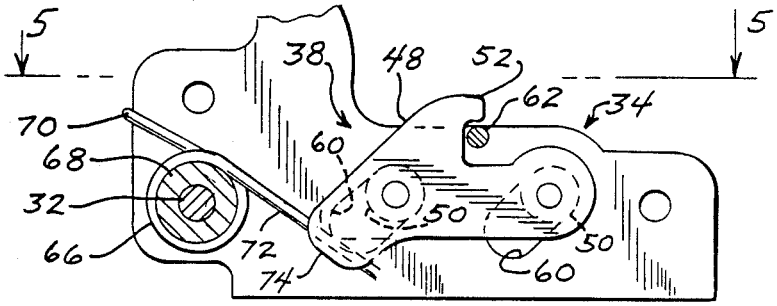
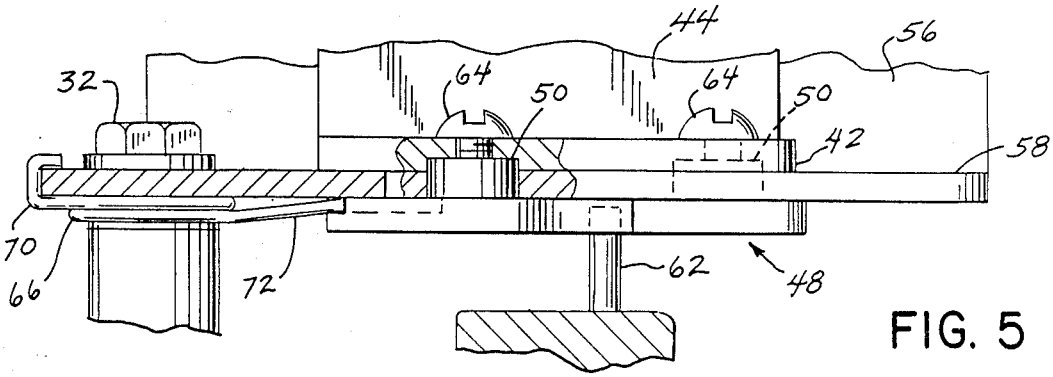
FIG. 5

INTERLOCK LATCH ASSEMBLY FOR RELEASABLY SECURING COWL SECTIONS OF AN OUTBOARD MOTOR

BACKGROUND AND SUMMARY

This invention relates to an outboard motor for a marine propulsion system, and more particularly to a latch structure for releasably securing separate cowl sections of an outboard motor.

It is known to provide a pivotable hook-type latch assembly for releasably securing upper and lower cowl sections of an outboard motor. Such a latch assembly typically includes a pivotably mounted hook interconnected with a pivotable latch lever. These components are mounted to one of the cowl sections. The other cowl section is provided with a catch assembly, which typically includes a stationary hook-engaging member. By operation of the pivotable lever, the hook is movable between an engaging position in which it engages the hook-engaging member provided on the catch assembly for securing the cowl sections together, and a disengaging position in which the hook and the hook-engaging member are disengaged, for releasing the cowl sections.

The above-described latch construction is typically employed in connection with a cowl design incorporating top and bottom cowl sections. In such a design, a compressible resilient rubber seal is provided between the cowl sections for improving the water resistance of the cowl assembly. An engagement structure is provided on the upper and lower cowl sections at one end of the cowl assembly for fixing the position of the cowl sections relative to each other. The pivotable latch assembly and its associated catch assembly are provided at the other end of the cowl assembly for releasably securing the cowl sections together upon engagement thereof. The latch assembly compresses the rubber seal between the cowl sections for improving the water resistance of the cowl assembly, thereby providing a pre-load on the hook and catch for ensuring that the hook and catch remain engaged.

It has been recognized that the hook may become disengaged with the hook-engaging member of the catch under certain operating conditions, resulting in disengagement of the top and bottom cowl sections. For example, when the lower unit of the outboard motor strikes a stationary obstacle, such as a submerged log or rock, the entire outboard motor assembly is caused to pivot about its tilt axis. In such a situation, the rubber seal between the cowl sections may be compressed, which relieves the pre-load provided between the hook and the catch due to compression of the rubber seal. The latch lever, due to its inertia, may then pivot about its pivot axis, thus moving the hook to its disengaging position. As the motor continues to pivot about its tilt axis and strikes the stops which define the allowable tilting movement of the unit, the top cowl section may continue to move forwardly due to its inertia and come loose from the bottom cowl section.

The present invention is designed to prevent the cowl sections from becoming disengaged with each other during operation. In accordance with the invention, a latch assembly for releasably securing first and second cowl sections together includes a catch mechanism connected to one of the cowl sections and a latch mechanism connected to the other of the cowl sections. The latch mechanism is movable between an engaging position in which the catch mechanism is engaged for securing the cowl sections together, and a disengaging position in which the latch mechanism and the catch mechanism are disengaged, for releasing the cowl sections. Interlock means is provided for preventing movement of the latch mechanism to its disengaging position when the latch mechanism is in its engaging position. The interlock means is normally disposed in a locking position for preventing such movement of the latch mechanism. The interlock means is movable to a release position for allowing movement of the latch mechanism to its disengaging position. In this manner, the latch mechanism is prevented from movement to its disengaging position except upon movement of the interlock means to its release position. In one embodiment, the latch mechanism comprises a catch-engaging portion and a movable latch handle for controlling the position of the catch-engaging portion. The interlock means is interconnected with the movable latch handle for preventing movement of the latch handle when it is positioned such that the latch mechanism is in its engaging position and the interlock means is in its locking position. The catch-engaging portion of the latch mechanism comprises a pivotable hook interconnected with the movable latch handle, which is pivotably mounted to one of the cowl sections for controlling the position of the hook. The interlock means preferably comprises a stationary interlock member mounted to one of the cowl sections, and a movable interlock member mounted to the latch handle and having a portion adapted to engage the stationary interlock member when the latch handle is positioned such that the latch mechanism is in its engaging position and the interlock means is in its locking position. The interlock means preferably includes bias means, such as a coil spring, for biasing the movable interlock member toward its locking position. The movable interlock member is movable by a user against the force of the bias means to its release position so as to allow pivoting movement of the latch handle to its disengaging position. Pivoting movement of the latch handle toward its engaging position causes the stationary member engaging portion of the movable interlock member to contact the stationary interlock member, and to move the movable interlock member toward its release position against the force of the bias means without operation of the movable latch member by the user. Continued pivoting movement of the latch handle toward its engaging position results in movement of the movable interlock member toward its locking position by the force of the bias means, and into engagement with the stationary interlock member. In a preferred embodiment, the movable interlock member is mounted to the latch handle by means of one or more slanted slots which accommodates such movement.

BRIEF DESCRIPTION OF THE DRAWINGS

The drawings illustrate the best mode presently contemplated of carrying out the invention.

In the drawings:

FIG. 3 is a partial side elevation view taken generally along lines 3—3 of FIG. 1;

FIG. 4 is a partial rear elevation view of the latch handle with the interlock mechanism mounted thereto, taken generally along lines 4—4 of FIG. 3;

FIG. 5 is a sectional view, with portions broken away, taken generally along lines 5—5 of FIG. 4;

DETAILED DESCRIPTION OF THE PREFERRED EMBODIMENT

Figure 1:
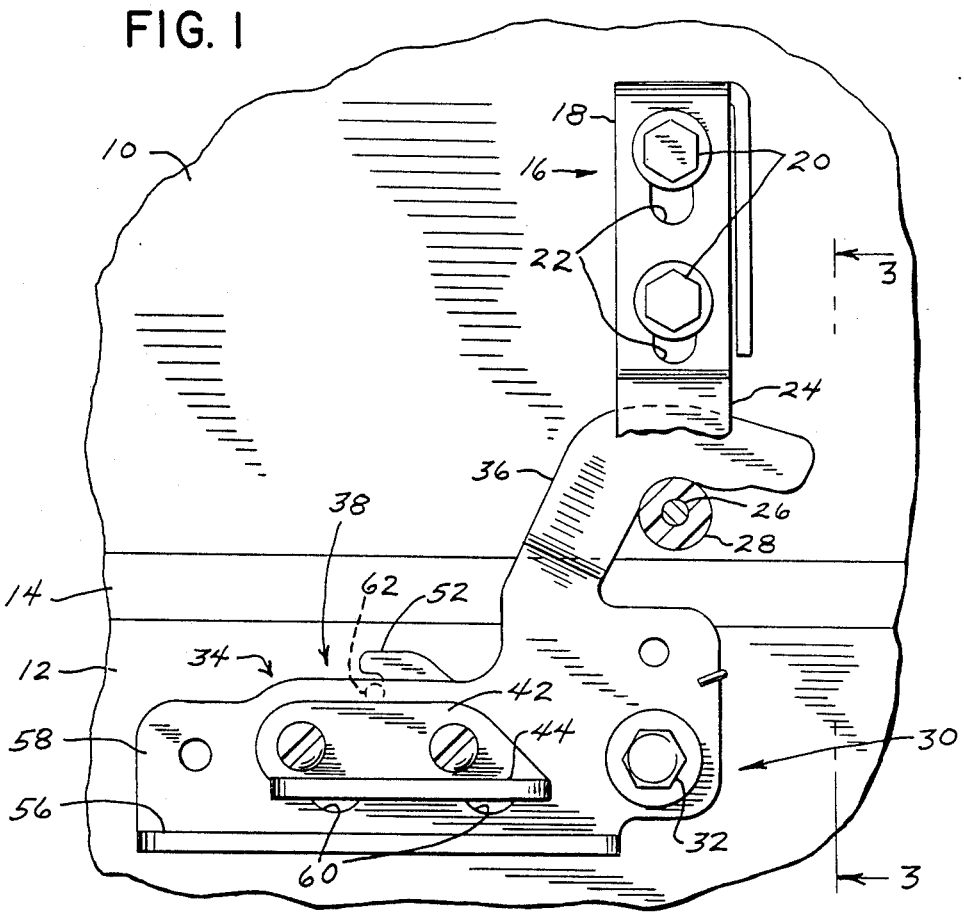
FIG. 1 is an elevation view, with portions broken away, of a catch assembly connected to an upper cowl section and a latch assembly connected to a lower cowl section, incorporating the interlock mechanism of the invention.

With reference to FIG. 1, an outboard motor includes a power head enclosed by an upper cowl section 10 and a lower cowl section 12. A compressible rubber seal 14 is provided at the joint between upper and lower cowl sections 10, 12. Rubber seal 14 acts to improve the water resistance of the cowl assembly for preventing entry of water into the interior thereof.

Upper cowl section 10 has a catch assembly, shown generally at 16, mounted to the exterior thereof. Catch assembly 16 includes a mounting bracket 18 which is adapted for mounting to upper cowl section 10 by means of a pair of bolts 20 extending through a pair of openings 22 provided in bracket 18. Bracket 18 further includes a depending side portion 24 spaced outwardly from the outer surface of upper cowl section 10. A pin 26 is connected between depending side portion 24 and upper cowl section 10, and a roller 28 is mounted thereto.

Lower cowl section 12 has a rotary latch assembly 30 mounted to the exterior thereof. Latch assembly 30 is pivotably mounted to lower cowl section 12 by means of a bolt 32. Latch assembly 30 generally includes a latch handle portion 34 and a hook portion 36. As will be explained in detail hereinafter, a movable interlock mechanism, shown generally at 38, is mounted to latch handle 34.

Figure 2:
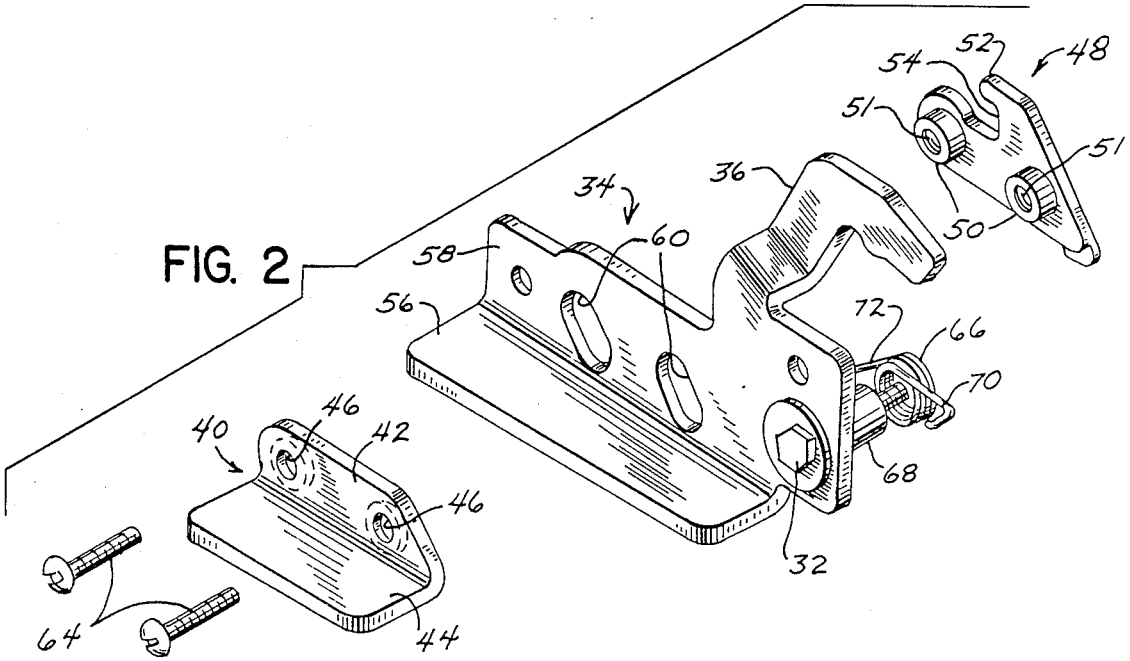
FIG. 2 is an exploded isometric view showing the components of the interlock mechanism of the invention in relation to the latch assembly.

As best seen in FIG. 2, interlock mechanism 38 includes a front interlock section 40 having an upstanding portion 42 and a lower portion 44. A pair of openings 46 are formed in upstanding portion 42. Interlock mechanism 38 further includes a rear interlock section 48 having a pair of circular bosses 50 projecting therefrom. A threaded internal passage 51 is provided through each of bosses 50. Rear interlock section 48 has an upper engagement portion 52 formed over a cut-out portion 54.

With further reference to FIG. 2, latch handle 34 includes a lower surface 56 from which a vertical upstanding surface 58 extends. A pair of slanted slots 60 are formed in upstanding surface 58 of latch handle 34. Slots 60 are disposed at a 50° angle relative to lower portion 56 of latch handle 34.

As shown in FIGS. 1 and 3, an engagement pin 62 is provided on lower cowl section 12, extending outwardly therefrom. Engagement pin 62 is rigidly fixed to lower cowl section 12. As will be explained, engagement pin 62 and interlock mechanism 38 cooperate to prevent pivoting of latch handle 34 about bolt 32.

Interlock mechanism 38 is mounted to upstanding portion 58 of latch handle 34. Bosses 50 provided on rear interlock section 48 are adapted for placement into slanted slots 60 formed in upstanding portion 58, so that the front surfaces of bosses 50 project outwardly from upstanding portion 58 (FIG. 5). Front interlock section 40 is then positioned so that openings 46 therethrough are aligned with threaded passages 51 in bosses 50 of rear interlock section 48, and circular recesses in the rear face of upstanding portion 42 of front interlock section 40 receive the projecting portion of bosses 50. Threaded screws 64 are then installed through openings 46 in front interlock section 40, and threadedly engage threaded passages 51 through bosses 50 in rear interlock section 48 for mounting front and rear interlock members 40, 48 to upstanding surface 58 of latch handle 34. When so mounted, interlock mechanism 38 is movable upwardly and downwardly in an amount defined by the extent of slots 60 in upstanding surface 58 of latch handle 34.

A coil spring 66 is adapted for mounting to a sleeve 68 which extends rearwardly from latch handle 34 between the rear surface thereof and the outer surface of cowl section 12, for spacing latch assembly 30 therefrom. Spring 66 has a stationary arm 70 including a hooked end which engages the rightward end of vertical surface 58 of latch handle 34. A movable arm 72 of coil spring 66 is engaged with a slot provided in the lower portion of rear interlock member 48, defined by an overhanging lip 74 (FIGS. 2, 3) and the rear face of upstanding portion 58 of latch handle 34 when rear interlock member 48 is mounted thereto. With the provision of coil spring 66, movable arm 72 acts to bias interlock mechanism 38 toward its locking position, in which bosses 50 are disposed at the upper end of slots 60 formed in latch handle 34.

Figure 6:
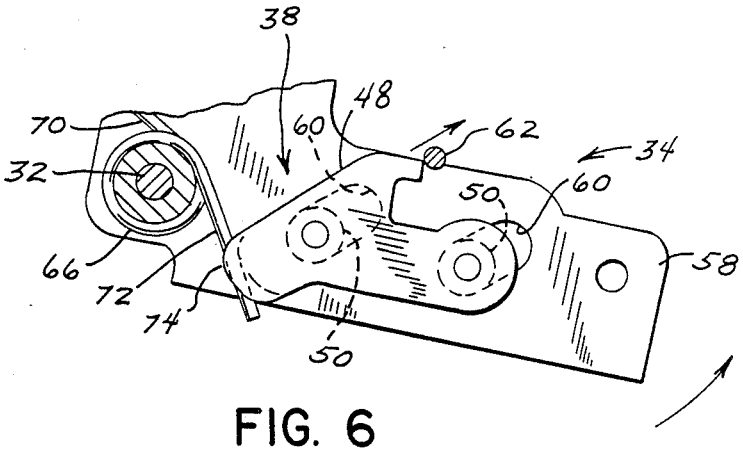
FIG. 6 is a view similar to FIG. 4, showing the interlock mechanism of the invention as the latch handle is being pivoted toward its engaging position.
Figure 7:
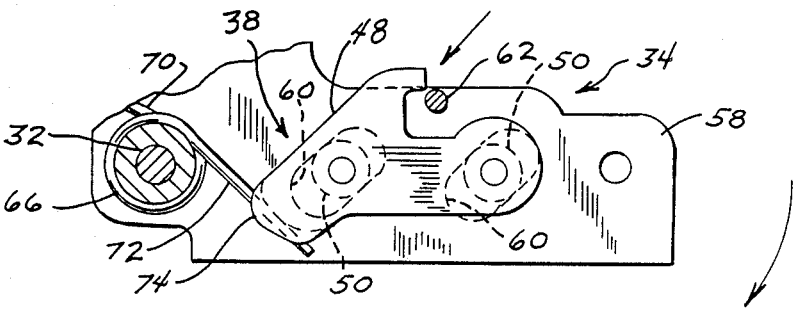
FIG. 7 is a view similar to FIGS. 4 and 6, showing the latch handle in its engaging position with the interlock mechanism being moved toward its release position, for allowing movement of the latch handle toward its disengaging position.

The operation of interlock mechanism 38 will now be described, with reference to FIGS. 1, 4, 6 and 7. Interlock mechanism 38 is normally biased by coil spring 66 toward its locking position, as shown in FIG. 1. In this position, latch handle 34 is prevented from pivoting about bolt 32, due to engagement of upper engagement member 52 of rear interlock member 58 with pin 62 provided on lower cowl section 12. In order to move latch handle 34 so as to position latch assembly 30 in its disengaging position in which hook 36 and roller 28 are disengaged, the operator manually moves interlock assembly 38 to its release position downwardly in slots 60, by pinching lower portion 44 of front interlock section 40 against lower portion 56 of latch handle 34. This action is shown in FIG. 7, wherein movement of interlock mechanism 38 along slots 60 causes upper engagement portion 52 of rear interlock section 48 to disengage pin 62. In this position, latch handle 34 is then manually pivotable about bolt 32 for disengaging hook 36 from roller 28, thereby releasing upper and lower cowl sections 10, 12. To reposition latch assembly 30 to its engaging position, in which hook 36 engages roller 28 for securing upper and lower cowl sections 10, 12 together, latch handle 34 is manually pivoted about bolt 32 in an upward direction, as shown in FIG. 6. Upon such pivoting of latch handle 34, upper engagement portion 52 of rear interlock section 48 contacts engagement pin 62 mounted to lower cowl section 12. This action causes downward movement of interlock mechanism 38 in slots 60 of latch handle 34, against the bias provided by coil spring 66. Upon further pivoting of latch handle 34 upwardly about bolt 32, upper engagement portion 52 of rear interlock section 48 clears engagement pin 62, so that coil spring 66 causes return of interlock mechanism 38 to its locking position, wherein upper engagement portion 52 is disposed above and in line with engagement pin 62, as shown in FIG. 4. As before, rotation of latch handle 34 is now prevented until interlock mechanism 38 is again moved to its release position by the user.

With the above-described construction, latch handle 34 is prevented from pivoting about bolt 32 unless interlock mechanism 38 is moved to its release position, an operation which must manually be performed by the user. In this manner, accidental release of hook 36 from catch assembly 16 is prevented.

Various alternatives and modifications are contemplated as being within the scope of the following claims particularly pointing out and distinctly claiming the invention.

I claim:

1. For an outboard motor or the like having a power head enclosed by first and second cowl sections, a latch assembly for releasably securing said first and second cowl sections together, comprising:

catch means connected to one of said cowl sections;

latch means movably connected to the other of said cowl sections, said latch means comprising a latch member having a hook portion and a handle portion disposed on opposite ends thereof, said latch means being movable between an engaging position in which the hook portion of said latch means engages said catch means for securing said cowl sections together, and a disengaging position in which said latch means and said catch means are disengaged; and interlock means mounted to the same cowl section to which said latch means is connected for preventing movement of said latch means to its disengaging position when said latch means is in its engaging position, said interlock means comprising:

a stationary interlock member mounted to and projecting outwardly from said cowl section;

a movable interlock member mounted to said latch member, said movable interlock member being movable between a locking position, in which movement of said latch member to its release position is prevented due to engagement of said movable interlock member with said stationary interlock member, and a release position for allowing movement of said latch member to its disengaging position; and bias means for biasing said movable interlock member toward its locking position.

2. The latch assembly according to claim 1, wherein said interlock means is interconnected with said latch handle portion for preventing movement of said handle portion when said handle portion is positioned so that said latch member is in its engaging position and said interlock means is in its locking position.

3. The latch assembly according to claim 2, wherein said movable latch member is pivotably mounted to said cowl section for controlling the position of said hook portion.

4. The latch assembly according to claim 3, wherein said movable interlock member is movable by a user against the force of said bias means to its release position so as to allow pivoting movement of said latch member to its disengaging position, and wherein pivoting movement of said latch member toward its engaging position causes said movable interlock member to contact said stationary interlock member so as to move said movable interlock member to its release position against the force of said bias means without operation of said movable interlock member by the user, and continued pivoting movement of said latch member to its engaging position results in movement of said movable interlock member to its locking position by the force of said bias means.

5. The latch assembly according to claim 4, wherein said movable interlock member is mounted to said latch member by means of one or more slanted slots which allow movement of said movable interlock member into and out of engagement with said stationary interlock member when said latch member is moved between its engaging position and its disengaging position, said movable interlock member being biased by said bias means against an end of said one or more slanted slots toward its locking position.

* * * * *

UNITED STATES PATENT AND TRADEMARK OFFICE

CERTIFICATE OF CORRECTION

PATENT NO. : 4,927,194

DATED : May 22, 1990

INVENTOR(S) : James L. Wagner

It is certified that error appears in the above-identified patent and that said Letters Patent is hereby corrected as shown below:

Title page:

Delete Assignee: Notron Engineering AG, Zollbruck, Switzerland and substitute therefore -- Assignee: Brunswick Corporation, Skokie, Ill. --.

Delete Attorney, Agent, or Firm -- Welsh & Katz, Ltd. and substitute therefore -- Attorney, Agent, or Firm -- Andrus, Sceales, Starke & Sawall --.

Signed and Sealed this

Twenty-ninth Day of October, 1991

*Attest:*

*Attesting Officer*

HARRY F. MANBECK, JR.

*Commissioner of Patents and Trademarks*